US005435401A

United States Patent [19]

Hedlund et al.

[11] Patent Number: 5,435,401

[45] Date of Patent: Jul. 25, 1995

[54] DOWN-THE-HOLE ROCK DRILL

[75] Inventors: Jan-Gunnar Hedlund; Leif Hedström, both of Houston, Tex.

[73] Assignee: Sandvik AB, Sandviken, Sweden

[21] Appl. No.: 244,819

[22] PCT Filed: Jan. 18, 1993

[86] PCT No.: PCT/SE93/00019

§ 371 Date: Aug. 19, 1994

§ 102(e) Date: Aug. 19, 1994

[87] PCT Pub. No.: WO93/15299

PCT Pub. Date: Aug. 5, 1993

[30] Foreign Application Priority Data

Jan. 22, 1992 [SE] Sweden ..... 9200168

[51] Int. Cl.[6] ..... E21B 4/06; E21B 10/38

[52] U.S. Cl. ..... 175/296; 175/415; 175/417

[58] Field of Search ..... 175/407, 414, 415, 416, 175/417, 296

[56] References Cited

U.S. PATENT DOCUMENTS 4,706,764 11/1987 Hughes ..... 175/415 X
5,150,636 9/1992 Hill ..... 175/417 X

FOREIGN PATENT DOCUMENTS 2192480 2/1974 France .
1221170 7/1966 Germany .
2401891 7/1975 Germany .
1242052 8/1971 United Kingdom .

*Primary Examiner*—David J. Bagnell
*Attorney, Agent, or Firm*—Burns, Doane, Swecker & Mathis

[57] ABSTRACT

A down-the-hole rock drill includes a top sub, a driver sub having a bore therein, and a piston case extending between and detachably connected to the top sub and the driver sub. A piston is located within the piston case, and a drill device is detachably connected to the driver sub. The drill device includes a shank and a head. The drill device also has a central passageway for a flushing medium. A tube is secured in the central passageway at a free end of the shank. The tube extends beyond the free end of the shank, and the piston has a central piston passageway that receives the tube. The piston is slidably movable relative to the tube. A first portion of the shank located closest to the head has a cross section, normal to a longitudinal center axis of the shank, in the shape of a multi-lobed figure that is continuously non-concave, and the bore of the driver sub is of a matching cross-sectional shape. In addition, the drill device is secured axially by a bit retainer that symmetrically cooperates with a circumferentially extending shoulder on a second portion of the shank. The second portion being located closest to the free end of the shank.

19 Claims, 3 Drawing Sheets

DOWN-THE-HOLE ROCK DRILL

BACKGROUND OF THE INVENTION a. Field of the Invention

The present invention refers to a down-the-hole rock drill.

b. Description of Related Art

The most common way by far to provide rotational driving between the shaft of a drill bit and a driver sub is to use splines both on the exterior of the shaft and on the wall of the bore of the driver sub. However, such a design of the cooperating rotational driving means of the shaft of the drill bit and the bore of the driver sub is complicated to manufacture and consequently the manufacturing is time consuming and expensive. According to GB-B-1 242 052 the conventional splines design suffers from the disadvantage that the splines of the chuck (driver sub) and the drill bit are caused to wear very rapidly by the repeated relative axial and angular movements between them.

From GB-B-1 242 052 a percussive rock drilling apparatus of the type defined above in the first paragraph is previously known. The aim of the design of the rotational driving means between the driver sub and the shaft of the drill bit as disclosed in GB-B-1 242 052 is to avoid said disadvantages concerning rapid wear and angular movements.

The known device according to GB-B-1 242 052 has a transverse pin secured in the driver sub (chuck) of the device, said pin cooperating with an axially extending flat surface on the shaft of the drill bit to restrict the axial displacement of the drill bit. However, such a structural design of the means for restriction of axial displacement of the drill bit relative to the driver sub will negatively affect the longitudinal centering of the shaft, during working conditions, relative to the bore of the driver sub. This is an extremely important feature for drill bits having an internal bore extending axially through the drill bit, i.e. drill bits of the type used in the down-the-hole rock drill according to the present invention. If, during working conditions, the shaft of the drill bit is not properly centered, relative to the bore of the driver sub, then there will be problems in the cooperation between the piston and the drill bit as regards the foot valve and the energy transmission.

Since the cooperation of the rotational driving means of the driver sub and the drill bit of GB-B-1 242 052 do not provide a longitudinal centering of the drill bit relative to the bore of the driver sub it is necessary to provide additional guiding means for the driver sub at the transition between the shaft and the head of the drill bit. The provision of such additional guiding means will of course negatively affect the manufacturing costs of the drill bit compared to a drill bit having no such guiding means.

OBJECTS AND SUMMARY

An object of the present invention is to present a down-the-hole rock drill having a drill bit including a shaft that is perfectly centered during working conditions relative to the bore of the driver sub.

A further object of the present invention is that according to a preferred embodiment of the present invention the guiding means at the bottom and/or top of the shaft of the drill bit are eliminated.

Another object of the present invention is to improve the radiused transmission between the shaft and the head of the drill bit.

Yet another object of the present invention is to improve the cooling of the interacting surfaces of the shaft of the drill bit and the bore of the driver sub.

Yet another object of the present invention is to achieve a less expensive manufacturing of the shaft of the drill bit and the bore of the driver sub.

The present invention refers to a down-the-hole rock drill including a top sub, a driver sub, a piston case extending between and detachably connected to said top sub and said driver sub, a piston located within said piston case, a drill bit detachably connected to said driver sub, said drill bit including a shank and a head, the drill bit having a central bit passageway for flushing medium and a number of branch passageways for flushing medium, said branch passageways extending from the central bit passageway to the front of the head, a tube means being secured in the central bit passageway, said tube means extending beyond the upper end of the drill bit, the piston having a central piston passageway that receives said tube means, said piston being slidably movable relative to said tube means.

BRIEF DESCRIPTION OF THE DRAWINGS

Below embodiments of the present invention will be described, reference being made to the accompanying drawings, where.

DETAILED DESCRIPTION OF PREFERRED EMBODIMENTS

Figure 1:
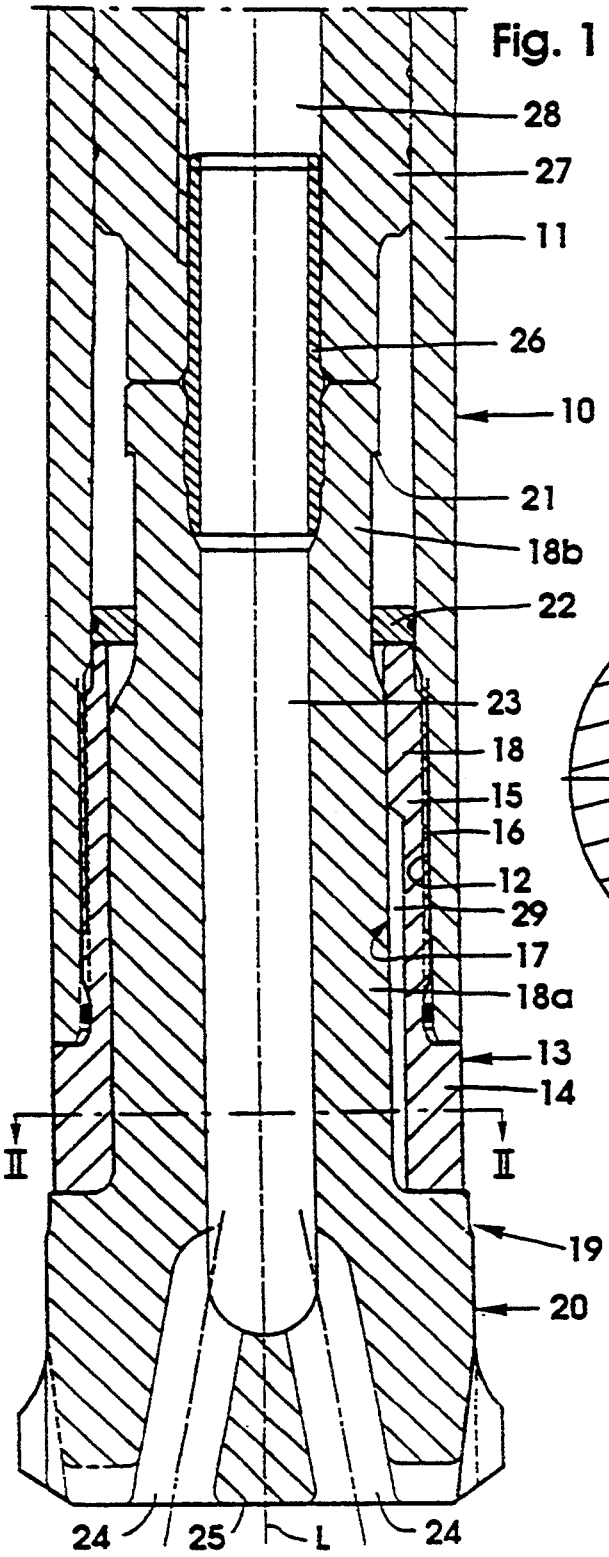
FIG.1 is a section through a lower part of a down-the-hole rock drill according to the present invention.
Figure 2A:
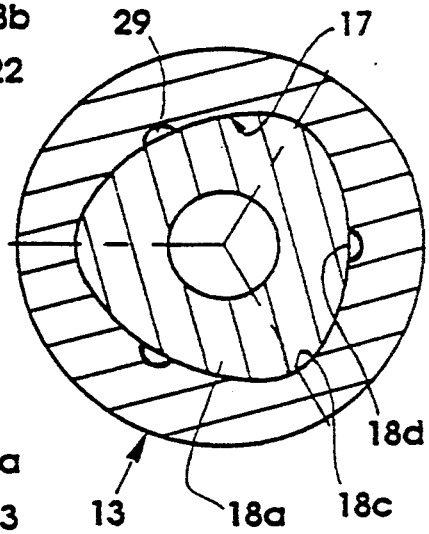
FIG. 2*a* is a section along II*a*—II*a* in FIG. 1.
Figure 2B:
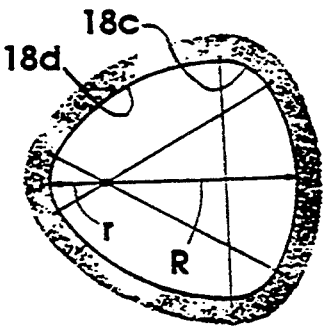
FIG. 2*b* is a cross-section of a first portion of a shank of a drill bit.

In FIGS. 1, 2*a* and 2*b* a preferred embodiment of the lower part of a down-the-hole rock drill 10 according to the present invention is disclosed. Said down-the-hole rock drill 10 has a longitudinal centre axis L. A generally cylindrical piston case 11 has an internal thread 12 at its lower end. A driver sub 13 has a lower portion 14 of the same outer diameter as the piston case 11. The upper portion 15 of the driver sub 13 has a reduced outer diameter, said upper portion 15 having an external thread 16 that in assembled state is adapted to engage the internal thread 12 of the piston case 11.

The driver sub 13 further has an internal bore 17 that is adapted to receive a shank 18 of a drill bit 19, said drill bit 19 further including a head 20 connected to the shank 18. Said head 20 is of conventional design and thus not forming a part of the present invention.

In the disclosed embodiment of FIGS. 1, 2*a* and 2*b* a first portion 18*a* of the shank 18, said first portion 18*a* being located closest to the head 20, has a regular cross-sectional shape with three convex lobes 18*c* and convex sides 18*d* connecting said lobes 18*c*. The bore 17 is of complementary cross-section to that of the first portion 18*a* of the shank 18.

In FIG. 2*b* said cross-sectional shape with three convex lobes of the first portion 18*a* is further defined. The convex lobes 18*c* have a radius of curvature r and the convex sides 18*d* have a radius of curvature R, said radius r being essentially smaller than said radius R. The cross-section of the first portion 18*a* has a further characteristic in that the distance between two parallel tangents to the periphery of said cross-section is always constant. In pertinent technical literature such a cross-sectional shape is denoted as a P3 profile.

There is of course a certain radial play between the bore 17 and the first portion 18*a* of the shank 18 although said radial play is considerably smaller than the radial play of a conventional splines connection. In the disclosed embodiment the regular cross-sectional shape with three convex lobes (P3) of the first portion 18*a* of the shank 18 reaches all the way to the head 20.

The second portion 18*b* of the shank 18, said second portion 18*b* being located closest to the free end of the shank 18, has a cylindrical cross-sectional shape and also includes a circumferential shoulder 21 that cooperates with a bit retainer ring 22 that rests against the upper end of the driver sub 13. The bit retainer ring 22 consists of two halves and prevents the bit 19 from axially falling out of the driver sub 13.

The shank 18 of the drill bit 19 is provided with a central, axially extending, bore forming a central bit passageway 23 for the flushing medium, said passageway 23 extending a limited distance into the drill head 10. A number of bores 24 extend from the front surface 25 of the drill head 10 to the bit passageway 23, said bores forming branch passageways 24 for the flushing medium, said branch passageways 24 having an angled extension relative to the longitudinal centre axis L of the device 10.

At the free end of the shank 18 a foot valve 26 is mounted, said foot valve 26 extending a limited distance into the central bit passageway 23.

Above the drill bit 19 a piston 27 is provided, said piston 27 being reciprocably movable in axial direction within the piston case 11. Said piston 27 is provided with a central, axially extending, bore forming a central piston passageway 28 for the flushing medium. When the piston 27 rests against the upper end of the drill bit 19 the foot valve 26 extends into the central piston passageway 28, the relative dimensions between the foot valve 26 and the central piston passageway 28 being such that the piston 27 is movable by slide fit relative to the foot valve 26.

As is evident from FIG. 2*a* the internal bore 17 of the driver sub 13 is provided with a number of lubricating/-venting grooves 29. The grooves 29 have an axial extension only in the lower part of the internal bore 17 of the driver sub 13. This is necessary since when the drill bit 19 is in its working position according to FIG. 1 there should be no free passageway between the shank 18 and the internal bore 17. However, when the drill bit 19 is in its open position, i.e. the shoulder 21 of the drill bit 19 rests against the bit retaining ring 22, then it is necessary to have a free passageway between the shaft 18 of the drill bit 19 and the internal bore 17 of the driver sub 13 since otherwise the reciprocal motion of the piston 27 will continue even when the drill bit 19 is in its open position.

The grooves 29 may have a helical extension in axial direction of the driver sub 13. Within the scope of the present invention it is also possible to provide lubricating/venting grooves (not shown) on the first portion 18*a* of the shank 18 of the drill bit 19. In analogy with what has been stated above regarding a free passageway between the shank 18 and the internal bore 17 such lubricating/venting grooves must extend axially only in the upper part of the first portion 18*a*. The lubricating/venting grooves on the first portion 18*a* may also have a helical extension in axial direction of the shank 18. The lubricating/venting grooves on the first portion 18*a* can replace the grooves 29 or be in combination with these.

It should be pointed out that the lubricating/venting arrangements described above are only examples of preferred embodiments. Thus, within the scope of the present invention other lubricating/venting arrangements than those described above are possible.

The improved function of the down-the-hole rock drill due to the features of the present invention is the following. When the down-the-hole rock drill is working the piston case 11 is rotated by a power source at the ground level. The piston case 11 will then confer a rotational driving to the shank 18 of the drill bit 19 due to the complementary shape of the cross-section of the first portion 18*a* of the shank 18 of the drill bit 19 and the internal bore 17 of the driver sub 13. The fact that said interaction between the first portion 18*a* of the shank 18 and the bore 17 takes place over a considerable length of the shank 18 and the fact that the complementary-shaped cross-section of said portions is a regular will result in a proper centering in axial direction of the shank 18 relative to the driver sub 13. This means that normally there is no need for additional centering means between the shank 18 and the driver sub 13.

Since the shank 18 has a proper centering relative to the driver sub 13 the cooperation between the foot valve 26 and the central piston passageway 28 of the piston 27 will be improved. When the piston 27 is in its uppermost position then the lower end of the piston 27 will be located above the upper end of the foot valve 26. When the piston 27 moves downwardly then the upper end of the foot valve 26 will enter the central piston passageway 28 at a certain stage. At that stage it is very important that the shank 18 is properly centered relative to the internal bore 17 of the driver sub 13 since otherwise the foot valve 26 may be damaged and/or subjected to stresses. Thus the centering feature of the present invention will reduce the friction forces between the foot valve 26 and the piston passageway 28. This is important both from a functional point of view and also as regards the length of life for the foot valve 26.

The transfer of percussive energy between the piston 27 and the drill bit 19 will also be improved if the shank 18 is properly centered relative to the internal bore 17 of the driver sub 13. Said centering will establish a full area contact between the lower end of the piston 27 and the upper end of the drill bit 19 when the piston 27 hits the drill bit 19.

The first portion 18*a* of the shank 18 and the internal bore 17 of the driver sub 13 are preferably manufactured by noncircular turning. Since the cross-section of said details has rather large radii the stress concentration will be reduced as compared to a conventional splines design. This also means that the creation of martensite due to friction is reduced.

In the disclosed embodiment the foot valve 26 is a tubular element of a rather limited axial extension. However, in the art there is also known a down-the-hole rock drill having a tubular element that has one end extending into the central bit passageway and the other end of the tubular element extending beyond the upper end of the piston, i.e. the tubular element extends through the piston. In such a design both the drill bit and the piston are movable relative to the tubular element by slide fit. The tubular element is secured axially at a location above the piston. The present invention is also applicable to down-the-hole rock drills of that type.

As is evident from FIG. 1 the first portion 18*a* of the shank 18, said first portion 18*a* having a cross-sectional shape in accordance with a preferred embodiment of the present invention, extends all the way up to the head 20 of the drill bit 19. However, within the scope of the present invention it is possible to have an alternative transition between the first portion 18*a* and the head 20, e.g. a cylindrical portion. The axial extension of such cylindrical portion should preferably be rather limited and the axial extension of the first portion 18*a* must always be sufficient to provide the centering/guiding function as described above.

Figure 3:
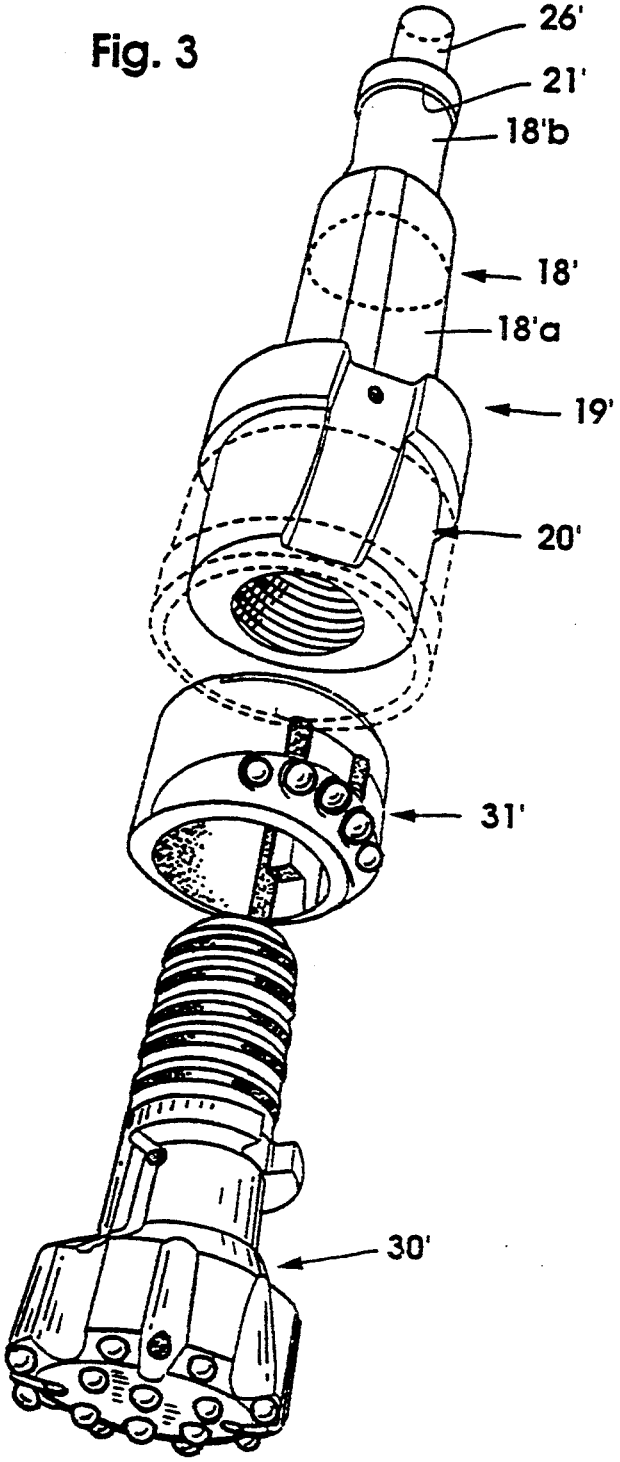
FIG. 3 is an exploded perspective view of an eccentric drill tool having a shank in accordance with the present invention.

In FIG. 3 the present invention is applied to an eccentric drill tool for a down-the-hole hammer. The drill tool according to FIG. 3 has a guide device 19' that includes a head 20' and a shank 18' having a first portion 18'*a* located closest to the head 20' and a second portion 18'*b* located closest to the free end of the shank 18'. The second portion 18'*b* has a shoulder 21'. The shank 18' of the guide device 19' in FIG. 3 corresponds to the shank 18 of the drill bit 19 in FIG. 1. The shank 18' is in the same way as the shank 18 received in a driver sub and secured axially by a retaining ring. In the same manner as the arrangement of FIG. 1 the driver sub is connected to a casing of a down-the-hole rock drill. The shank 18' has a central guide device passageway (not shown) extending axially through the guide device 19'. A foot valve 26' is mounted at the free end of the shank 18' said foot valve 26' extending into the guide device passageway a limited distance.

In principle the same advantages concerning centering of the shank 18' in the bore of the driver sub and transfer of percussive energy between the piston and the shank 18' of the guide device 19' apply to the embodiment of FIG. 3 as described above in connection with the embodiment of FIGS. 1 and 2(*a,b*). The first portion 18'*a* of the shank 18' is preferably manufactured in the same way as the first portion 18*a* of the shank 18, i.e. by non-circular turning. Also the cross-sectional shape of the first portion 18'*a* is equal to the cross-section shown in FIG. 2*b*.

The drill tool according to FIG. 3 further has a central pilot bit 30' that is detachably connected to the guide device by a thread coupling. A reaming bit 31' is mounted on the shank of the pilot bit 30' closest to the head of said pilot bit 30'. The reaming bit 31' is rotatable a limited angle relative to the pilot bit 30'. The drill tool according to FIG. 3 is used for simultanously drilling and casing through overburden.

In FIGS. 4*a*–4*e* a number of alternative cross-sectional shapes of the first portion 18*a*,18'*a* of the shank 18,18' are shown.

Figure 4A:
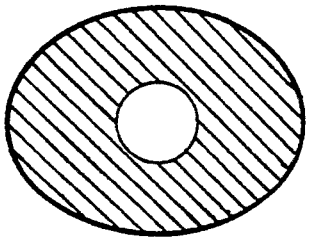
FIGS. 4*a*–4*e* are alternative embodiments of the cross-section of a first portion of a shank of a drill bit.

FIG. 4*a* shows a cross-section in the shape of an ellipse.

Figure 4B:
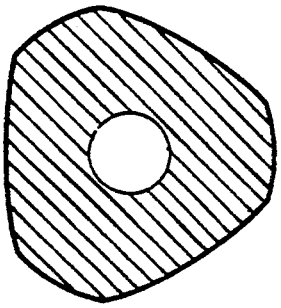

FIG. 4*b* shows a cross-section that is a modification of the cross-section shown in FIG. 2, the difference being that the lobes are somewhat flattened although still being convex. In pertinent technical literature the cross-section of FIG. 4*b* is denoted as a PC3 profile.

Figure 4C:
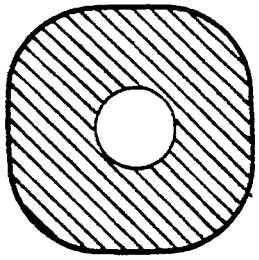

FIG. 4*c* shows a cross-section of generally square shape. In pertinent technical literature the cross-section of FIG. 4*c* is denoted as a P4 profile.

Figure 4D:
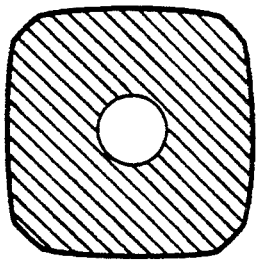

FIG. 4*d* shows a cross-section of generally square shape. Compared to the figure of FIG. 4*c* the figure of FIG. 4*d* has more flattened lobes/corners. In pertinent technical literature the cross-section of FIG. 4*d* is denoted as a PC4 profile.

Figure 4E:
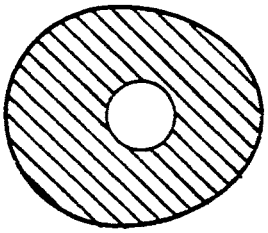

FIG. 4*e* shows a cross-section that is a combination of a semi-elliptic and a semi-circular shape.

The profiles referred to above having a "P" prefix (e.g. P3 profile) are often in pertinent technical literature called polygon profiles and they are subject to a proposed DIN standard.

The basic concept of the present invention is a cross-section of the first portion 18*a*;18'*a* being a multi-lobed figure that is continuously non-concave. This definition is valid for all the embodiments of the first portion of the shank that are shown in this application. Preferably it is a regular figure, i.e. the sides are of equal length.

However, the invention is in no way restricted to the embodiments described above but can be varied freely within the scope of the appending claims.

We claim:

1. A down-the-hole rock drill, comprising:

a top sub, a driver sub having a bore therein, a piston case extending between and detachably connected to said top sub and said driver sub, a piston located within said piston case, a drill device detachably connected to said driver sub, said drill device including a shank and a head, the drill device having a central passageway means for a flushing medium, a tube means being secured in the central passageway means at a free end of the shank.

said tube means extending beyond the free end of the shank, the piston having a central piston passageway that receives said tube means, said piston being slidably movable relative to said tube means, a first portion of the shank located closest to the head has a cross-section, normal to a longitudinal center axis of the shank, in the shape of a multi-lobed figure that is continuously nonconcave, and that the bore of the driver sub is of a matching cross-sectional shape, and the drill device is secured axially by a bit retaining means that symmetrically cooperates with a circumferentially extending shoulder means on a second portion of the shank, said second portion being located closest to the free end of the shank.

2. Down-the-hole rock drill according to claim 1, wherein the cross-sectional shape of the first portion of the shank is regular.

3. Down-the-hole rock drill according to claim 1, wherein the cross-sectional shape of the first portion is continuously convex.

4. Down-the-hole rock drill according to claim 1, wherein the first portion of the shank has a three-lobed cross-sectional shape that is regular, and that the distance between two parallel tangents to the periphery of said cross-section is constant.

5. Down-the-hole rock drill according to claim 1, wherein the bit retaining means is of annular shape, and that said bit retaining means at least partially surrounds the second portion and cooperates with a shoulder means on said second portion on the shank.

6. Down-the-hole rock drill according to claim 5, wherein the bit retaining means is in two pieces.

7. Down-the-hole rock drill according to claim 1, wherein said drill device is a drill bit.

8. Down-the-hole rock drill according to claim 7, wherein the first portion of the shank extends all the way to the head of the drill bit.

9. Down-the-hole rock drill according to claim 1, wherein said drill device is a guide device.

10. A drill bit adapted to constitute a part of a down-the-hole rock drill, said drill bit comprising:

a shank and a head, the drill bit having a central bit passageway for a flushing medium and a number of branch passageways for the flushing medium, said branch passageways extending from the central bit passageway to the front of the head, a first portion of the shank being located closest to the head has a cross-section, normal to a longitudinal center axis of the shank, in the shape of a multi-lobed figure that is continuously nonconcave, a second portion of the shank being located closest to a free end of the shank is provided with a circumferentially extending shoulder means for cooperating with a bit retaining means.

11. Drill bit according to claim 10, wherein the first portion of the shank has a regular cross-sectional shape.

12. Drill bit according to claim 10, wherein the first portion of the shank has a cross-sectional shape with three convex lobes and convex sides connecting said lobes.

13. Drill bit according to claim 10, wherein the first portion of the shank has a four-sided cross-sectional shape.

14. Drill bit according to claim 10, wherein the central bit passageway, at its end directed to the free end of the shank, is designed to receive a tube means.

15. A guide device adapted to constitute a part of a down-the-hole rock drill, said guide device comprising:

a shank and a head, the guide device having a central guide device passageway means for a flushing medium, a first portion of the shank being located closest to the head has a cross-section, normal to a longitudinal center axis of the shank, in the shape of a multi-lobed figure that is continuously nonconcave, a second portion of the shank, said portion being located closest to a free end of the shank, is provided with a circumferentially extending shoulder means for cooperating with a bit retaining means symmetrically arranged around the second portion of the shank.

16. Guide device according to claim 15, wherein the first portion of the shank has a regular cross-sectional shape.

17. Guide device according to claim 15, wherein the first portion of the shank has a cross-sectional shape with three convex lobes and convex sides connecting said lobes.

18. Guide device according to claim 15, wherein the first portion of the shank has a four-sided cross-sectional shape.

19. Guide device according to claim 15, wherein the central guide device passageway, at its end directed to the free end of the shank, is designed to receive a tube means.

* * * * *